United States Patent [19]

Walker

[11] Patent Number: 5,068,903

[45] Date of Patent: Nov. 26, 1991

[54] METHOD OF AND ARRANGEMENT FOR LINEARIZING THE FREQUENCY RESPONSE OF A LOUDSPEAKER SYSTEM

[75] Inventor: Michael Walker, Baltmannsweiler, Fed. Rep. of Germany

[73] Assignee: Alcatel N.V., Amsterdam, Netherlands

[21] Appl. No.: 427,828

[22] Filed: Oct. 27, 1989

[30] Foreign Application Priority Data

Oct. 28, 1988 [DE] Fed. Rep. of Germany ..... 3836745

[51] Int. Cl.[5] ..... H04R 3/00

[52] U.S. Cl. ..... 381/96; 381/59; 381/98

[58] Field of Search ..... 381/96, 59, 98

[56] References Cited

U.S. PATENT DOCUMENTS 3,872,247 3/1975 Saville et al. ..... 381/96
4,712,247 12/1987 Swarte ..... 381/96
4,797,933 1/1989 Hahne ..... 381/96
4,908,870 3/1990 Nagi ..... 381/96

FOREIGN PATENT DOCUMENTS 3339108 9/1985 Fed. Rep. of Germany .
3637666 5/1988 Fed. Rep. of Germany .

*Primary Examiner*—Forester W. Isen
*Attorney, Agent, or Firm*—Christie, Parker & Hale

[57] ABSTRACT

The frequency response of a loudspeaker system can be linearized in a simple manner by negative voltage feedback. However, pure negative voltage feedback has the disadvantage of compensating mechanical resonance phenomena of the loudspeaker system only incompletely. A method and an arrangement are proposed in which the feedback signal is derived from the impedance of the loudspeaker system. The measure of the impedance of the loudspeaker system is the current flowing through the loudspeaker system. The signal corresponding to the impedance is filtered and fed back to the input of the power amplifier.

3 Claims, 2 Drawing Sheets

METHOD OF AND ARRANGEMENT FOR LINEARIZING THE FREQUENCY RESPONSE OF A LOUDSPEAKER SYSTEM

TECHNICAL FIELD

The present invention relates to a method of and an arrangement for linearizing the frequency response of a loudspeaker, particularly for suppressing resonance phenomena.

CLAIM FOR PRIORITY

This application is based on and claims priority from an application first filed in Fed. Rep. Germany on Oct. 28, 1988 under Ser. No. 38 36 745.9. To the extent such prior application may contain any additional information that might be of any assistance in the use and understanding of the invention claimed herein, it is hereby incorporated by reference.

BACKGROUND ART

Published German patent specification DE-OS 36 37 666 discloses a phase- and amplitude-controlled loudspeaker with an arbitrary number of paths. The aim of the control is to linearize the frequency response (phase-+amplitude) of an electroacoustic transducer. The electroacoustic transducer may be a single loudspeaker, but also an arrangement consisting of two or more loudspeakers. The closed-loop control system consists of a power amplifier, a passive crossover network, a summing amplifier, and one or more loudspeakers. The controlled variable is the voltage driving the loudspeakers, which is fed back to the input of the power amplifier. The feedback path contains an operational amplifier with a feedback network. The controlled variable can also be derived from other sensing elements (see FIG. 1).

The prior art controlled loudspeaker has the disadvantage that only negative voltage feedback is provided, which has little effect on the dynamic range of the loudspeaker. If the loudspeaker is driven at a frequency which is very close to a resonance point of the loudspeaker enclosure, the power radiated by the loudspeaker will vary widely, which, however, is hardly reflected in the drive voltage. Under such operating conditions, the prior art control has only little effect.

DISCLOSURE OF INVENTION

It is an object of the invention to linearize the frequency response of a loudspeaker or a loudspeaker system in such a way as to compensate for the effect of, for example, mechanical resonances caused by the physical dimensions of the enclosure. The power radiated by the loudspeaker or loudspeaker system is thus made more frequency-independent.

In accordance with the invention the controlled variable is not the voltage delivered by a power amplifier, but the impedance of the loudspeaker system. The impedance of a loudspeaker system shows sharp peaks near mechanical resonance points, it being irrelevant whether these are natural resonances of the loudspeaker or natural resonances of the enclosure. The impedance of the loudspeaker system is preferably measured by the current flowing through the loudspeaker system. The power radiated by the loudspeaker system is preferably varied by controlling the current flowing through the loudspeaker system (negative current feedback).

By feedback of a filtered signal proportional to the impedance of the loudspeaker system, the frequency response may be linearized, or brought to a desired shape, for other frequency ranges as well, particularly for frequencies below 200 Hz.

BRIEF DESCRIPTION OF DRAWINGS

An embodiment of the invention will now be described in more detail with reference to the accompanying drawings, in which.

BEST MODE FOR CARRYING OUT THE INVENTION

Figure 1A:
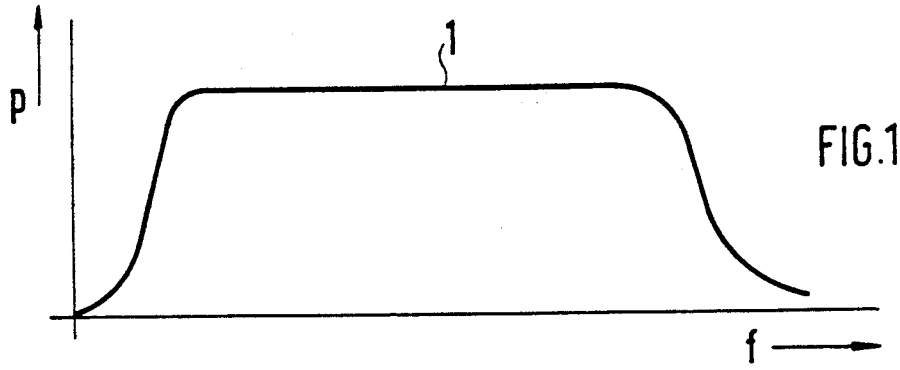
FIG. 1*a* shows the sound pressure of an idealized loudspeaker as a function of frequency.
Figure 1B:
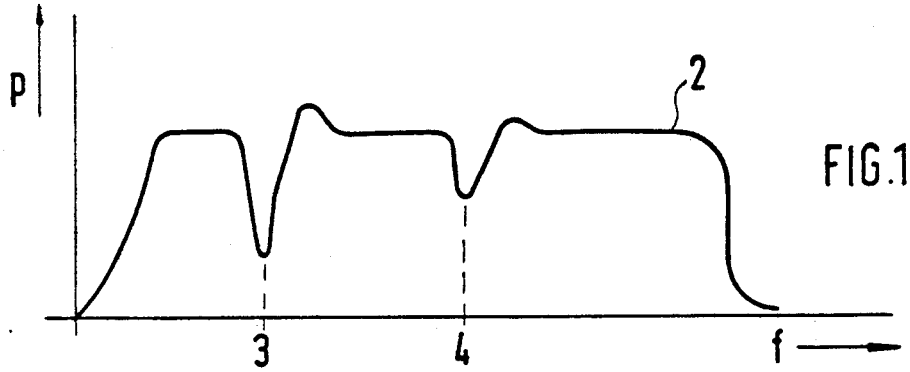
FIG. 1*b* shows the sound pressure of a real loudspeaker as a function of frequency.

When driven with constant electric power, electroacoustic transducers, hereinafter also referred to as "loudspeaker systems", should radiate frequency-independent acoustic power over a wide frequency range. In FIG. 1, the sound pressure p of an idealized loudspeaker is plotted as a function of the frequency f. The sound pressure p is independent of the frequency over a wide frequency range (reference character 1). Curve 2 in FIG. 1*b* shows the sound pressure of a real loudspeaker system as a function of frequency. At the frequencies denoted by 3 and 4, mechanical resonances occur in the loudspeaker system. Near such a resonance point, the sound pressure first drops off sharply, then passes through a minimum, subsequently rises above the desired value, and then drops back to the desired value. Sound-pressure curves such as curve 2 in FIG. 1*b* are undesirable for electroacoustic transducers.

Figure 1C:
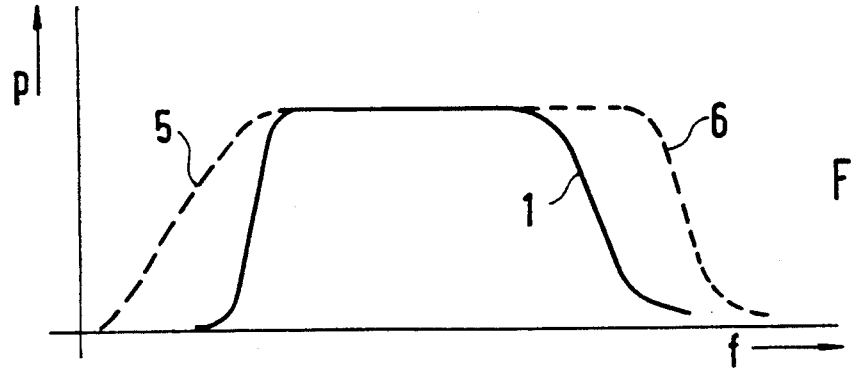
FIG. 1*c* shows the sound pressure of a loudspeaker as a function of frequency, with base and treble boosted.

In FIG. 1*c*, curve 1 again represents the sound pressure of an (ideal) loudspeaker as a function of frequency. Measures which will be discussed in connection with FIG. 2 cause the low frequencies to be emphasized (5) and the upper cutoff frequency to be raised (6).

Figure 2:
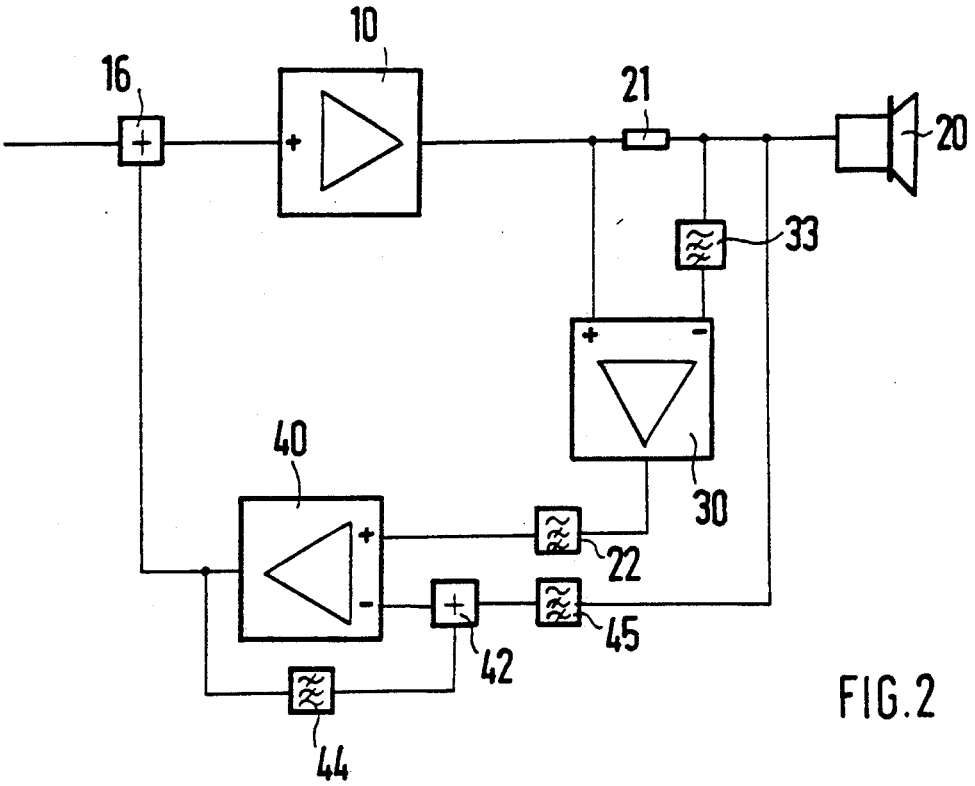
FIG. 2 is a block diagram of a circuit for controlling the power radiated by an electroacoustic transducer.

FIG. 2 shows the principle of a circuit for controlling the power radiated by an electroacoustic transducer. A power amplifier 10 delivers the electric power required to drive a loudspeaker system 20. The current flowing through the loudspeaker system 20 is sensed by a current-sensing resistor 21. The voltage developed across the current-sensing resistor 21 is applied to a first operational amplifier 30. Through a high-pass filter 33, the voltage applied to the loudspeaker system 20 is connected to the inverting input of the operational amplifier 30. A second operational amplifier 40 amplifies a difference signal derived from the output of the operational amplifier 30 and the voltage applied to the loudspeaker system. The output of the operational amplifier 30 and the noninverting input of the operational amplifier 40 are interconnected via a third high-pass filter 22. The voltage signal is applied through a second high-pass filter 45 and an adder 42 to the inverting input of the operational amplifier 40. The feedback path of the operational amplifier 40 contains a low-pass filter 44, whose output is added to the signal from the high-pass filter 45 at the summing point 42. The output voltage of the operational amplifier 40 is added in an adder 16 to a low-frequency voltage to be amplified, and applied to the input of the power amplifier 10. The circuit uses negative current feedback and works as follows. The current driving the loudspeaker system 20 causes a voltage drop across the current-sensing resistor 21, which is amplified by the operational amplifier 30. The gain of the amplifier 30 is chosen so that in operating conditions in which no mechanical resonances occur in the loudspeaker system 20, the output voltage of the amplifier 30 is equal in magnitude and phase to the voltage applied to the loudspeaker system. The latter voltage is applied through the second high-pass filter 45 to the inverting input of the amplifier 40, and the output voltage of the amplifier 30 is applied through the high-pass filter 22 to the noninverting input of the amplifier 40. Thus, the output of the operational amplifier 40 is normally zero.

At resonance, the system oscillates with considerably lower power consumption while the resulting measurable electric impedance of the loudspeaker voice coil increases-resonance step-up in the parallel resonant circuit. The voltage driving the loudspeaker system remains unchanged while the current through the loudspeaker system greatly decreases; in other words, the signal applied to the operational amplifier 30 decreases. As a result, a nonzero difference signal is now applied to the operational amplifier 40. This signal is amplified by the operational amplifier 40, and the output of the latter is combined at the summing point 16 with the low-frequency voltage to be amplified. If the high-pass filters 22, 33 and 45 are suitably chosen, the two signals will be superposed so that the acoustic power radiated by the loudspeaker system remains constant. The measures described also improve the pulse response of the loudspeaker system, since the mechanical oscillations excited by pulses are quickly damped as a result of the negative feedback.

The circuit principle illustrated in FIG. 2 has yet another advantage. With low-cost electroacoustic transducers, the reproduced spectrum frequently does not include the low frequencies below 200 Hz. At frequencies below 200 Hz, the sound pressure clearly decreases, so that the reproduced sound becomes shrill. The impedance of the loudspeaker system also decreases at these frequencies. If the lower cutoff frequency of the high-pass filter 45 is chosen to be higher than that of the filter 22, a 180° phase shift will be obtained in the correction signal below the cutoff frequency. This phase shift causes positive feedback in this frequency range (cf. FIG. 1*c*, 5). This improves the response of the loudspeaker system at low frequencies. With the aid of the filter 44, the response at high frequencies can be influenced (cf. FIG. 1*c*, 6).

Figure 3:
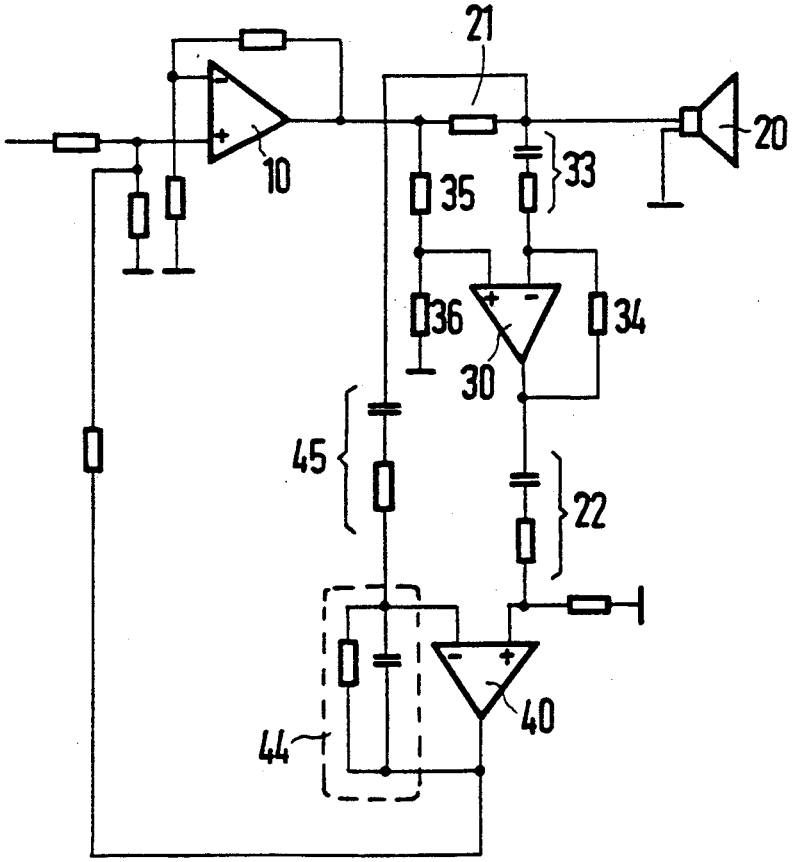
FIG. 3 shows an example of a circuit based on the block diagram of FIG. 2.

FIG. 3 shows an example of a circuit based on the block diagram of FIG. 2. Elements having the same functions as in FIG. 2 are designated by similar reference characters. The circuit need not be described here in detail since the gist of the invention lies in the underlying principle rather than in the construction of the circuit. It should be noted that the operational amplifier 30 is of symmetrical design, i.e., the resistor 35 and the resistor in the high-pass filter 33 are equal in value and so are the two resistors 34 and 36.

I claim:

1. Arrangement for improving the frequency response of a loudspeaker system comprising:

a power amplifier driving the loudspeaker system, a current-sensing resistor for inter-connecting the power amplifier and the loudspeaker system, a first operational amplifier responsive to a first voltage developed across the current-sensing resistor to produce a second voltage derived therefrom, a second operational amplifier responsive to a difference between a third voltage applied to the loudspeaker system and the second voltage, and a high-press filter between the output of the first operational amplifier and the noninverting input of the second operational amplifier.

2. Arrangement for improving the frequency response of a loudspeaker system comprising:

a power amplifier driving the loudspeaker system, a current-sensing resistor for inter-connecting the power amplifier and the loudspeaker system, a first operational amplifier responsive to a first voltage developed across the current-sensing resistor to produce a second voltage derived therefrom, a second operational amplifier responsive to a difference system and the second voltage, and high-pass filter responsive to the third voltage and connected to the inverting input of the second operational amplifier.

3. Arrangement for improving the frequency response of a loudspeaker system comprising:

a power amplifier driving the loudspeaker system, a current-sensing resistor for inter-connecting the power amplifier and the loudspeaker system, a first operational amplifier responsive to a first voltage developed across the current-sensing resistor to produce a second voltage derived therefrom, a second operational amplifier responsive to a difference between a third voltage applied to the loudspeaker system and the second voltage, a first high-pass filter between the current-sensing resistor and an inverting input of the first operational amplifier, a second high-pass filter responsive to the third voltage and connected to the inverting input of the second operational amplifier, and a third high-pass filter between the output of the first operational amplifier and the noninverting input of the second operational amplifier.

* * * * *